US006023946A

United States Patent [19]

Magi

[11] Patent Number: 6,023,946

[45] Date of Patent: Feb. 15, 2000

[54] DECORATIVE CHAIN

[75] Inventor: Raffaello Magi, Arezzo, Italy

[73] Assignee: Uno A Erre Italia S.p.A., Arezzo, Italy

[21] Appl. No.: 08/636,154

[22] Filed: Apr. 22, 1996

[30] Foreign Application Priority Data

Apr. 28, 1995 [IT] Italy ..... FI95A0085

[51] Int. Cl.[7] ..... A44C 5/02

[52] U.S. Cl. ..... 63/9; 63/4; 63/38

[58] Field of Search ..... 63/3, 4, 9, 21, 63/5.1, 7, 38; 59/2, 29, 30, 35.1, 80

[56] References Cited

U.S. PATENT DOCUMENTS 1,829,880 11/1931 Stockert ..... 63/38

1,840,681 1/1932 Seidman et al. ..... 63/4

2,681,545 6/1954 Hall ..... 63/4

3,685,284 8/1972 Taubner, Jr. ..... 63/4

*Primary Examiner*—Kien T. Nguyen

*Attorney, Agent, or Firm*—Hopgood Calimafde Kalil & Judlowe

[57] ABSTRACT

A decorative chain formed from small hollow balls engaged by connection segments (103) is transformed by subjecting the small balls of the chain to deformations by beating; the chain is then articulated. The main faces (101A) of the deformed small balls (101) can be surface-treated by diamond engraving or satin-finishing or other surface treatments.

1 Claim, 2 Drawing Sheets

DECORATIVE CHAIN

DESCRIPTION

Chains are known—even decorative ones—which are defined as chains with balls and which are formed from small hollow balls engaged by connection segments made from a small bar shaped and truncated in the connection segments in the region of reductions in section which the small bar has inside the small balls.

The aim of the invention is to modify the appearance of a decorative chain of the type defined above, for esthetic requirements and also to obtain a greater aspect of the chain. These and other aims will become clear from the text which follows.

Essentially, the process in question envisages that the small balls of the chain are subjected to deformations by beating, after which the chain is articulated.

There are thus obtained from the small balls deformed bodies having two main faces which can be surface-treated, by diamond engraving and/or satin-finishing or other surface treatments.

The deformations of the small balls can be accentuated to involve the expansions of the small bars which are inside the small balls and which are also deformed during the beating operation; it is thus possible to reduce, or even to prevent, relative rotations between adjacent deformed small balls about the axis of the connection segments. In this manner, a chain, even after articulation, has all the small balls deformed with one and the same face visible and their articulation is limited and is possible only in the plane in which the small balls are flattened and in relation to this plane.

The beating—even repeated—can be such as to impose specific geometric shapes of the cross-sections and/or of the perimeter of the deformed small balls.

The invention also relates to a chain with balls with the small balls deformed to appear flattened, obtained using the above process. The small balls can be deformed to the point of not being able to undergo relative rotations with one another about the axis of the connection segments, as a result of which the two main faces of the adjacent deformed small balls are rigidly orientated and visible from one and the same side. Said faces can also be decorated using surface treatments which may also differ on the two faces of each small ball. The deformed small balls are limitedly inclinable in relation to one another in the plane of their greater extension and from said plane.

The invention will be better understood by following the description and the attached drawing which shows a non-limiting practical embodiment of the invention. In the drawing.

Figure 1:
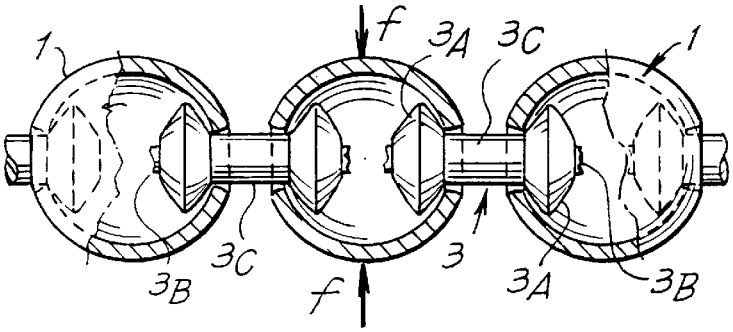
FIG. 1 shows a starting length of chain with balls for transformation according to the process in question.

According to what is illustrated in the attached drawing, in FIG. 1, 1 indicates small hollow balls obtained using a process of deformation of a relatively thin tubular material made of plastic metal, which are engaged on a small bar 3 which is shaped by turning or in another suitable manner and has, inside each small ball, an expansion 3A, in which a reduction in section 3B is made so as to allow, with an articulation operation, the breaking off of these reduced sections 3B and therefore a breaking up of the small bar 3 into a plurality of segments 3C, each of which is capable of connecting a small ball to an adjacent small ball; the breaking up into segments of the small bar 3 thus makes it possible to produce an articulated chain. These chains have an esthetic shape linked to the essentially spherical shape of the bodies 1 which, however, although not rigidly spherical, are of approximately circular cross-section at every point at which the geometric sections are made. The invention makes it possible to modify this inevitable shape of the spherical bodies 1 or equivalent so as to modify esthetically the appearance of the chain and also to enlarge its surface aspect in relation to what is conferred by the profile essentially of revolution which is currently imposed with the abovementioned working known per se on the spherical bodies 1 or equivalent.

Figure 2:
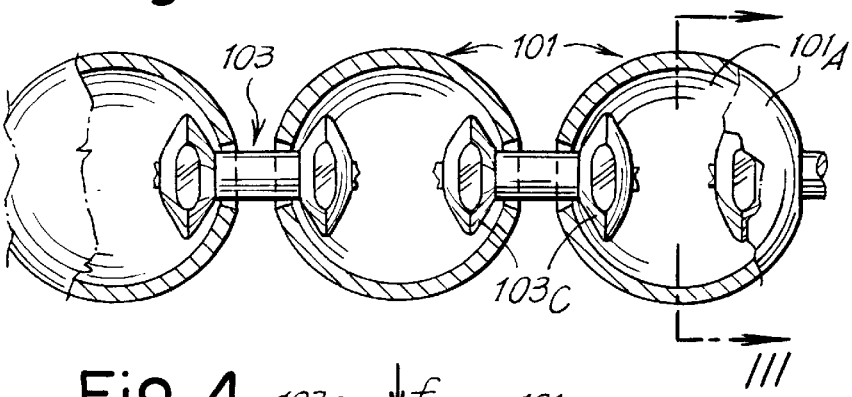
FIGS. 2, 3 and 4 show a front view, a cross-section III—III of FIG. 2 and a view along IV—IV in FIG. 2 in partial section, of a possible shape of chains with small balls deformed according to the process in question.
Figure 3:
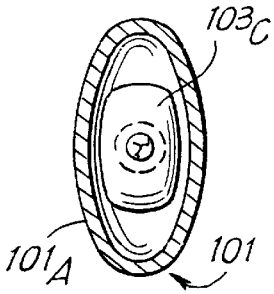
Figure 4:
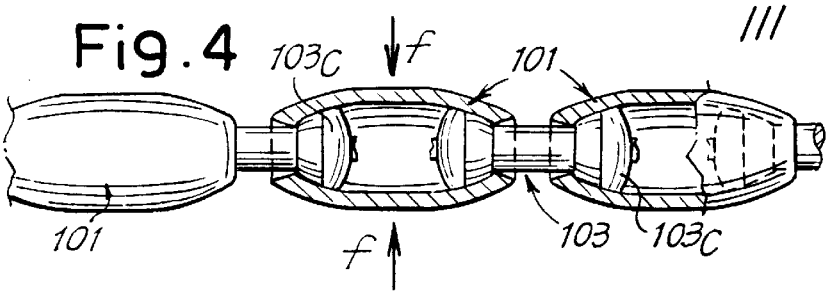
Figure 5:
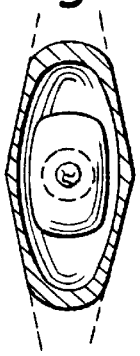
FIGS. 5, 6 and 7 show cross-sections similar to FIG. 3, with possible surface workings.
Figure 6:
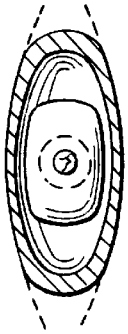
Figure 7:
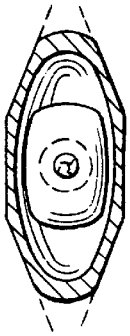
Figure 8:
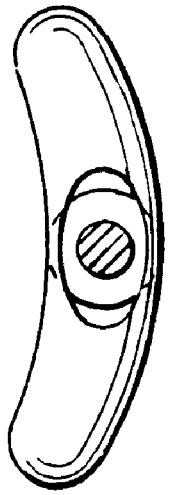
FIG. 8 shows a possible variant shape of the deformed small balls as an alternative to the shape visible in FIG. 3.

According to the invention, before the breaking up of the small bar, that is to say before the articulation, the spherical bodies 1 of the chain are subjected to a beating action according to the arrows f in FIGS. 1 and 4, so as to deform them by squashing before articulation and therefore before the breaking off in the region of the reduced sections 3B of the small connection bar 3. The beating can be carried out with operations which are successive and intercalated with annealing treatments, depending on the nature, the thickness and the dimensions of the small balls and the shape which is to be imposed on the small balls to obtain essentially lenticular bodies such as 101 in FIGS. 2 to 4. The essentially lenticular bodies indicated by 101 can have different shapes depending on the shape of the beating members with which the beating itself is carried out. Modification of the shape of the bodies of revolution 1 to obtain the essentially lenticular bodies indicated by 101 can be such that these acquire a shape of approximately elliptical section or with surfaces which are curved or also partially flattened and curved, as indicated for example in FIGS. 3 and 8. In each case, the deformation of the small balls to the bodies 101 is such that contact is brought about with the expansions 3A and that a deformation is caused of these expansions also to for example the state 103C with limited possibility of sliding between the internal surface of the hollow and deformed bodies 101 and the deformed expansions 103C inside the hollow bodies 101. It follows from this firstly that the lenticular bodies 101 are essentially engaged against rotation about the axis of the connection pieces 103 and this makes it possible to maintain the angular position of the individual lenticular bodies 101 in such a position that the main faces 101A (which are formed with the beating and the deformation of the small balls or other bodies of revolution 1) all face in the same direction. Between adjacent lenticular bodies 101, limited inclinations are possible in the plane in which said lenticular bodies lie and in relation to this plane. A chain thus obtained, for which relative rotation about the axis of the connection pieces 103 is difficult, is thus capable of being made visible fundamentally with one or the other of the faces 101A of the bodies 101 which are relatively larger than in the case of the bodies 1 of revolution (whether spherical or not). This enhances the external appearance of the chain and also makes it possible to work the surfaces of these faces 101A with ease and thus render the chain more decorative as illustrated in FIGS. 2 to 4 compared with the chain with bodies of revolution or with small balls like the starting chain indicated in FIG. 1 of traditional shape. The decorations can be a satin finish, diamond engraving, or of other types; the decorations on one face of the lenticular bodies 103 can be different from the decoration on the opposite face, as a result of which one and the same decorative chain, worn on one side or on the other side, can offer a different appearance depending on the front surface 101A which comes to be visible. In FIGS. 5 to 7, various possibilities of diamond engraving are shown, on four flat faces, on two curved faces and on six flat surfaces respectively.

Figure 9:
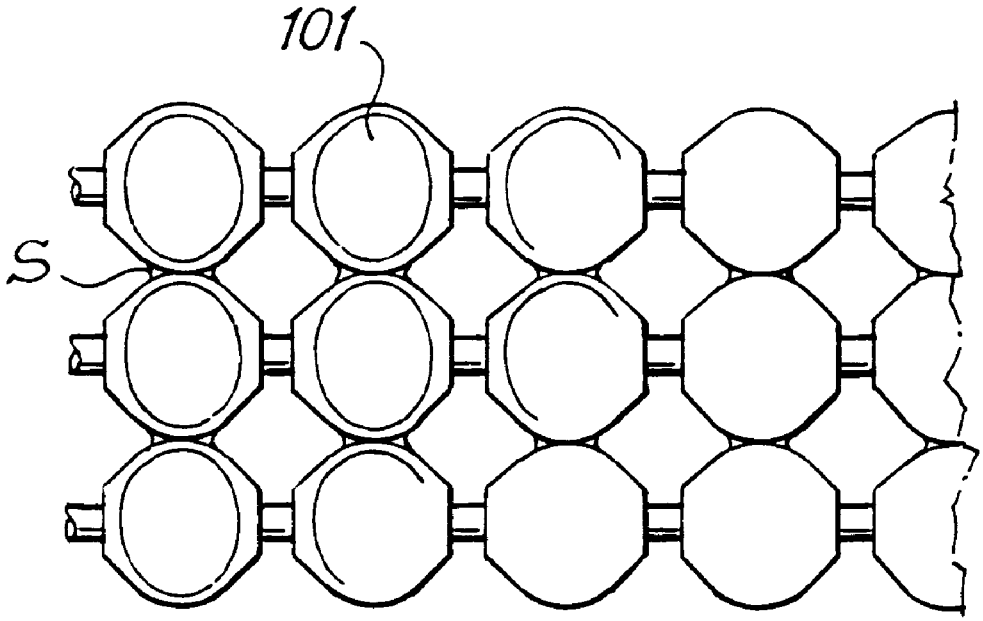
FIG. 9 shows a portion of a piece of jewelry consisting of a number of chains with deformed small balls.

A chain thus produced can also be used to be placed side by side with other chains and to obtain a band-like piece of jewelry, with the lenticular bodies 101 of chains placed side by side, which can be welded at least every so often to stabilize the band-like shape of a series of adjacent and mutually parallel rows of chains, with at least some of the adjacent lenticular bodies of the various rows of chains being welded for a connection between the various rows of chains constituting a band. In FIG. 9, a portion of a piece of jewelry thus produced is shown, in which S indicates weld points between various bodies 101, it being possible for these weld points to be more or less frequent in the band-shaped structure thus produced.

It is understood that the drawing shows only an exemplification given solely by way of practical demonstration of the invention, it being possible for this invention to vary in from and arrangement without thereby leaving the scope of the concept which forms the invention itself.

I claim:

1. A chain comprising at least two small balls connected to each other by a connection segment and said balls deformed to appear flattened in the manner of lenticular bodies, wherein the small balls have a hollow and are connected with a connection segment having an expanded portion disposed within said hollow, and the small balls are deformed effective to deform the expanded portion of the connection segment inside the balls effective to prevent relative rotation of the balls about the axis of the connection segments.

* * * * *